United States Patent [19]

Foster et al.

[11] 4,337,609

[45] Jul. 6, 1982

[54] ENVELOPE STUFFING APPARATUS

[75] Inventors: Dean H. Foster, Stratford; Harold Silverman, Norwalk, both of Conn.

[73] Assignee: Pitney Bowes Inc., Stamford, Conn.

[21] Appl. No.: 188,173

[22] Filed: Sep. 17, 1980

[51] Int. Cl.[3] ..... B65B 35/50

[52] U.S. Cl. ..... 53/569; 53/266 A

[58] Field of Search ..... 53/569, 571, 266 A, 53/381 R, 384

[56] References Cited

U.S. PATENT DOCUMENTS 3,319,395 5/1967 Lundquist et al. ..... 53/569

4,205,506 6/1980 Moens et al. ..... 53/569

*Primary Examiner*—W. D. Bray

*Attorney, Agent, or Firm*—Donald P. Walker; William D. Soltow, Jr.; Albert W. Scribner

[57] ABSTRACT

In envelope stuffing apparatus which has an enclosure inserting station and includes a deck at the inserting station, structure for delivering the envelope in a path of travel to the inserting station, structure for opening the envelope and structure for inserting an enclosure into the envelope; and wherein the opening structure includes a ledge for supporting the flap of the envelope above the deck, and a first finger insertable into the envelope for stripping apart from each other the front and back panels of the envelope; there is provided an improvement in the envelope opening structure. The improvement comprises: a solenoid operable in response to delivery of the envelope to the inserting station; a second finger for depressing the envelope toward the deck against the resistance of the flap supporting ledge; and a linkage assembly. The linkage assembly interconnects the second finger and solenoid for normally holding the second finger out of the path of travel of delivery of the envelope and for lowering the second finger into engagement with the envelope when the solenoid is operated, whereby the envelope is depressed toward the deck after the envelope is delivered. And the lowered second finger depresses the envelope sufficiently to open the envelope to permit insertion of the first finger into the envelope.

8 Claims, 3 Drawing Figures

ENVELOPE STUFFING APPARATUS

BACKGROUND OF THE INVENTION

Envelope stuffing machines, for example of the type shown in U.S. Pat. No. 2,736,999 issued Mar. 6, 1956 to F. J. Rouan et. al., U.S. Pat. No. 2,914,895 issued Dec. 1, 1959 to S. W. Martin, U.S. Pat. No. 4,077,181 issued Mar. 7, 1978 to L. K. Asher et. al., and U.S. Pat. No. 4,169,341 issued Oct. 2, 1979 to F. T. Roetter et. al., all of which patents are assigned to the assignee of the present invention, generally include: conventional structure for delivering an envelope, with its address panel oriented upwardly and its flap opened, to a registration gate at an enclosure inserting station; conventional structure for timely opening the delivered envelope, including a plurality of fingers known in the art as stripper fingers, which are insertable into the throat of the envelope for opening the same; and conventional structure for inserting an enclosure into the opened envelope. More particularly, the envelope opening structure conventionally includes a plate which acts as a ledge upon which the flap of the envelope is located when it is delivered to the inserting station. And, although none of the aforesaid patents show the same, the assignee of the present invention has for many years provided in its Model 3320 Table Top Inserter, one or rigid finger members, known in the art as depressor fingers, which are fixedly attached to the framework of the Inserter and disposed in overhanging relationship with respect to the envelope's address panel, for depressing the body of the envelope downwardly against the resistance afforded by the envelope flap ledge, for partially opening the throat of the envelope to facilitate insertion of the stripper fingers into the envelope.

Operators of the aforesaid Model 3320 Inserter have experienced difficulties with the same due to the aforesaid fixed depressor fingers tending to prevent delivery of the envelope to the registration gate. Accordingly, many operators have been bending the depressor fingers away from the path of travel of the envelope to ensure delivery to the registration gate, as a result of which the force exerted on the envelope by the depressor fingers is reduced and the envelope is insufficiently depressed to permit entry of the stripper fingers into the envelope for opening the same. Accordingly, misfeeds resulting from improper envelope registration and failure to open the envelopes have been found to be directly attributable to the provision of the fixed depressor fingers. Further, when the fixed depressor finger structure hereinbefore described was replaced in a Model 3320 Inserter by structure in accordance with the present invention, the failure rate of one misfeed per 22 stuffing cycles experienced with the fixed depressor finger structure was reduced to one misfeed per 180 stuffing cycles.

Accordingly:

an object of the present invention is to provide improvements in envelope stuffing apparatus;

another object is to provide such apparatus with improved means for opening an envelope;

another object is to provide such apparatus with means for depressing the envelope for opening the same after delivery thereof to the enclosure inserting station; and another object is to provide such apparatus with means, operable in response to delivery of the envelope to the inserting station, for depressing the envelope sufficiently to open the same enough to permit entry of the stripper fingers into the envelope.

SUMMARY OF THE INVENTION

In envelope stuffing apparatus having an inserting station and including a deck at the inserting station, and including means for delivering the envelope in a path of travel to the inserting station, and including means for opening the envelope, and including means for inserting an enclosure into the envelope and removing the envelope from the inserting station, and wherein the opening means includes means for supporting the flap of the envelope above the deck, and includes first finger means insertable into the envelope for stripping apart from each other the front and back panels of the envelope, there is provided an improvement in the envelope opening means. The improvement comprises: a solenoid means operable in response to delivery of the envelope to the inserting station; second finger means for depressing the envelope toward the deck against the resistance of the flap supporting means; and linkage means interconnecting the second finger means and solenoid means for normally holding the second finger means out of the path of travel of delivery of said envelope and for lowering the second finger means into engagement with the envelope when the solenoid means is operated, whereby the envelope is depressed toward the deck after the envelope is delivered, and the lowered second finger means depressing the envelope sufficiently to open the envelope enough to permit insertion of the first finger means into the envelope.

BRIEF DESCRIPTION OF THE DRAWINGS

As shown in the drawings, wherein like reference numerals designate like or corresponding parts throughout the several views.

DESCRIPTION OF THE PREFERRED EMBODIMENT

Figure 1:
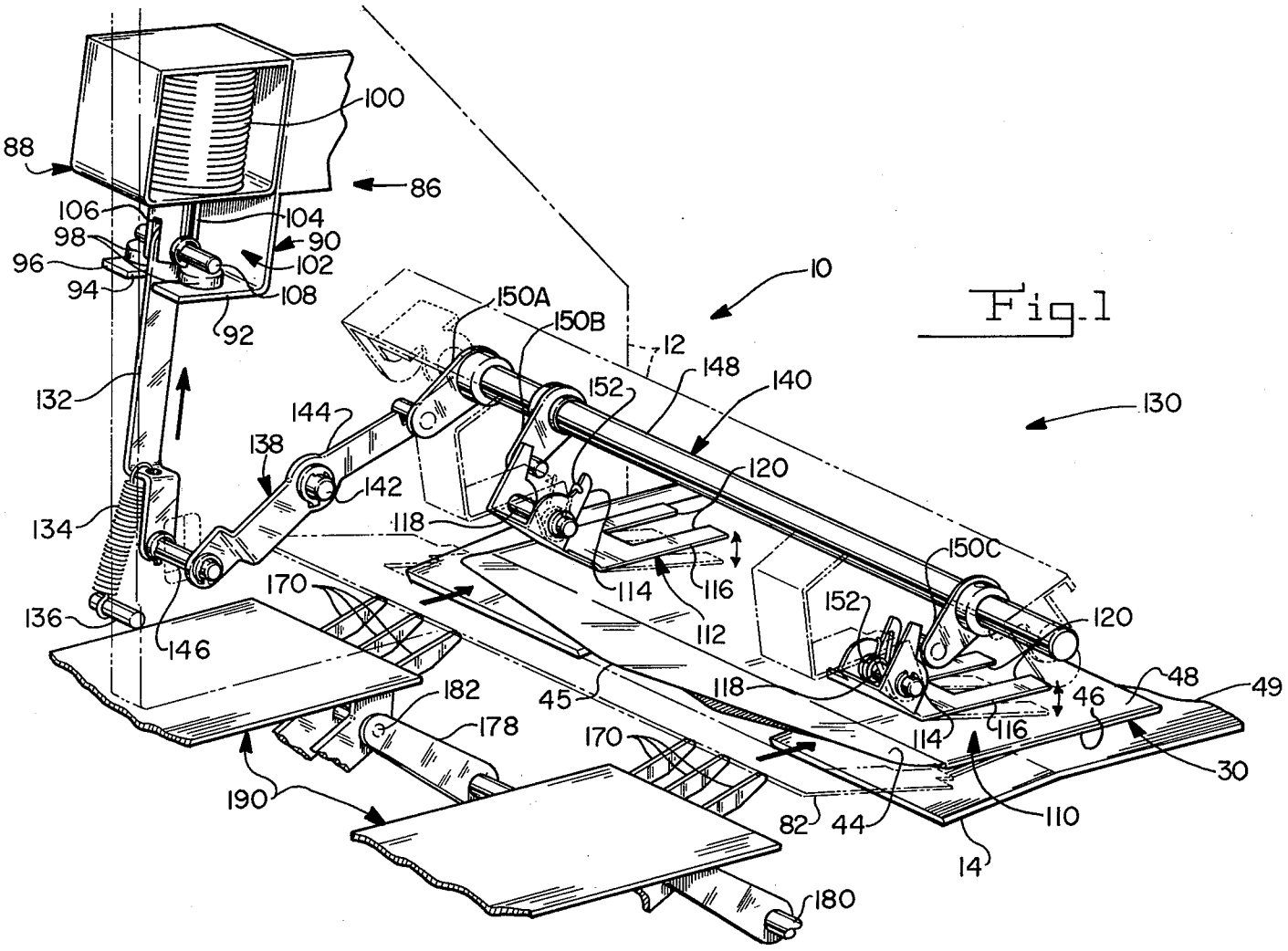
FIG. 1 is a fragmentary perspective view of an envelope stuffing machine showing the improved envelope opening means according to the invention.
Figure 2:
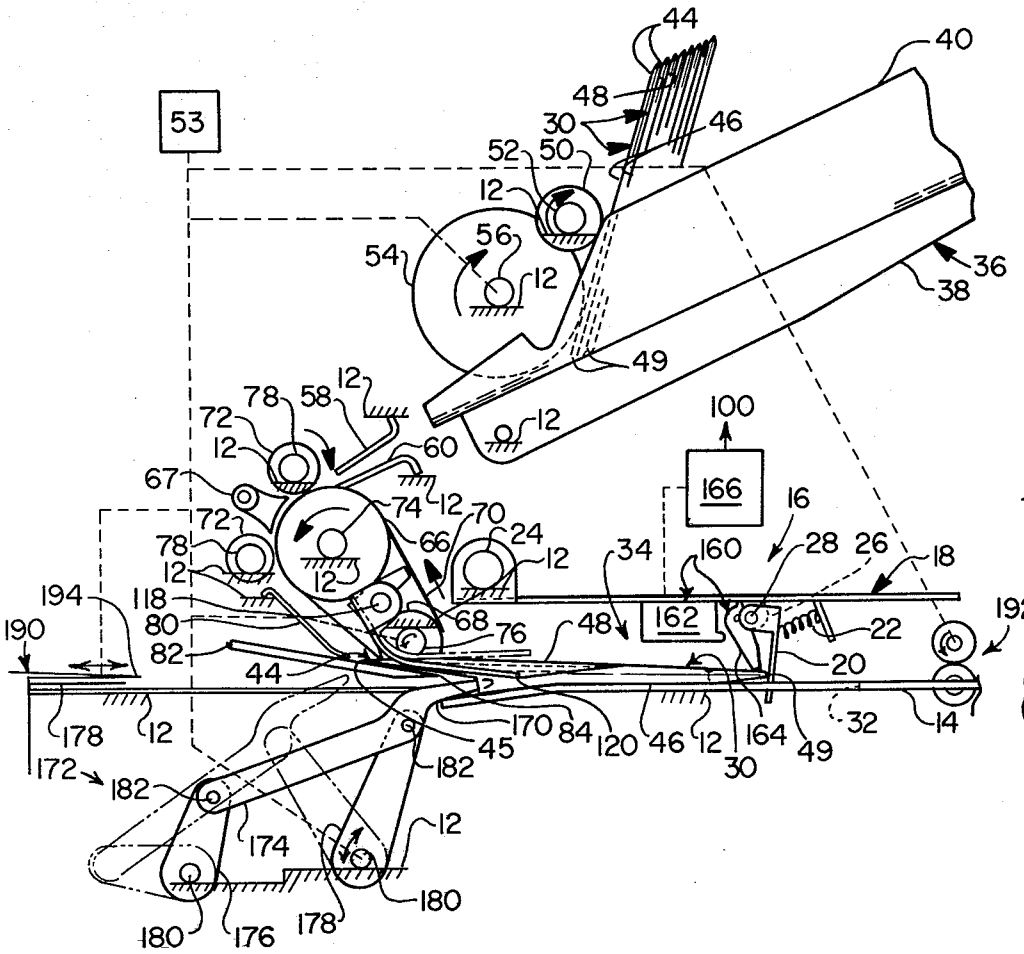
FIG. 2 is a fragmentary side view of an envelope stuffing machine showing the improved envelope opening means of FIG. 1; and showing an envelope delivered to the inserting station and the depressor fingers of the improved opening means lowered against the address panel of the envelope.

An envelope stuffing machine 10 (FIG. 1) of the type which may be improved in accordance with the present invention comprises conventional framework 12 for supporting the various components of the machine 10 including an envelope deck 14 and envelope gating structure 16 (FIG. 2).

Figure 3:
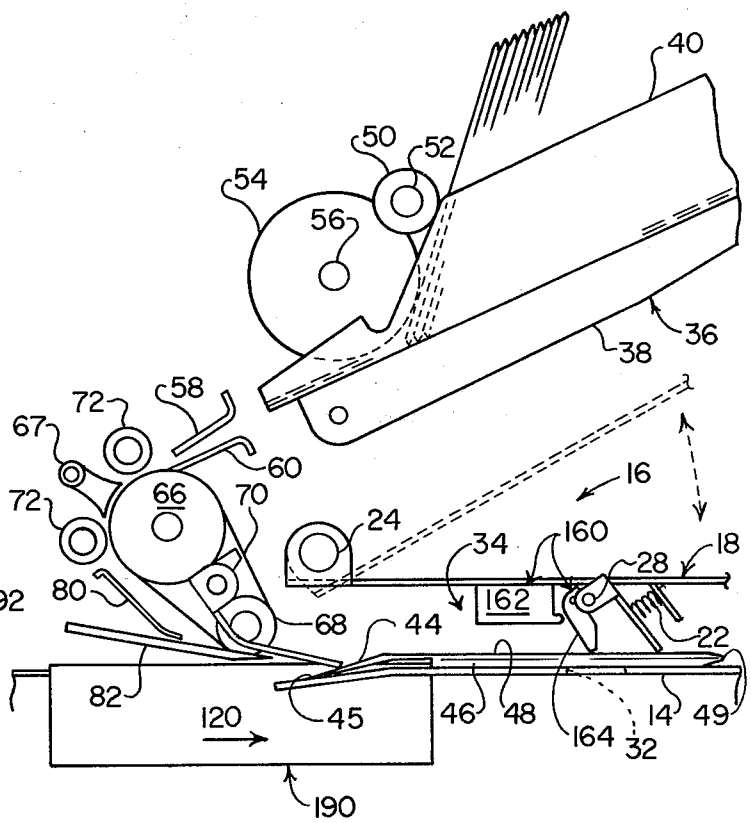
FIG. 3 is a view of the apparatus of FIG. 2, showing the stuffed envelope, partially moved downstream from the inserting station, and showing the depressor fingers lowered against the stuffed envelope as it is being moved downstream from the inserting station.

The envelope gating structure 16 (FIG. 2) includes a deck cover 18, gate 20 and spring 22. The deck cover 18 is conventionally pivotably attached to the framework 12, as by means of a pin 24, to facilitate raising the gating structure 16 from its normal position shown in FIG. 2 to a raised position, for example as shown by the dashed lines (FIG. 3), for jam clearing purposes. The cover 18 (FIG. 2) includes a depending bracket 26 to which the gate 20 is conventionally pivotably attached, as by means of a pivot pin 28, so as to depend from the cover 18. The gate 20 normally extends into the path of travel of an envelope 30 delivered to the deck 14 and through a suitable opening 32 formed in the deck 14. The spring 22 has one end suitably attached to the cover 18 and the other end suitably attached to the gate 20 for holding the gate 20 in the aforesaid normal position, wherein the gate 20 and deck 14 cooperate to define an enclosure inserting station generally designated by the numeral 34.

For delivering envelopes 30 (FIG. 2) to the enclosure inserting station 34, the machine 10 includes conventional means for supplying envelopes 30 and for feeding the envelopes 30, one at a time, to the inserting station 34.

The envelope supplying means includes a suitable hopper 36. The hopper 36 includes a tray 38 which is upwardly inclined at an angle of approximately 25 degrees from the horizontal, for gravity feeding the envelopes 30 toward the envelope feeding means. To that end, the tray 38, and thus the hopper 36, is located so as to dispose the lowermost envelope 30 in gravity feeding relationship with respect to the envelope feeding means. In addition, the envelope supplying means includes a pair of upright envelope side guide walls 40 (one of which is shown). The tray 38 is conventionally removably attached to the framework 12 to facilitate removal for access to the envelope feeding means. And the side guide walls 40 are conventionally movably attached to the tray 38 to facilitate moving the guide walls 40 toward and away from each other for accommodating different sizes of envelopes 30.

In the Model 3320 Inserter hereinbefore referred to, the envelopes 30 (FIG. 2) are stacked in the hopper 36 with their flaps 44 closed and extending downwardly. However, as hereinafter discussed, downstream from the hopper 36 there is provided conventional means for opening the flaps 44 and orienting the same upwardly. Accordingly, upon arrival of the envelope 30 at the inserting station 34, the flap edges define the upper end edges 45 of the envelopes 30. In the hopper 36, the back panels 46 of the envelopes 30 are oriented so as to face the lower end of the hopper 36; as a consequence of which the front, or address, panels 48 are faced away from the lower end of the hopper 36. And the envelopes' lower edges 49 are disposed in sliding engagement with the tray 38.

The envelope feeding means (FIG. 2) includes one or more driven, first feed rollers 50, each of which is conventionally mounted on a first rotatable shaft 52. The shaft 52 is suitably journalled to the framework 12 so as to extend across the lower end of the hopper 36, downstream of the lowermost envelope 30 so as to locate the roller(s) 50 for rotation in engagement with the back panel 46 of the lowermost envelope 30 in the hopper 36 for pre-feeding the envelopes 30 from the hopper 36. And the shaft 52 is conventionally connected to, for example, a conventional source of supply of motive power 53 for timely rotating the shaft 52. The envelope feeding means also includes one or more second feed rollers 54, each of which is conventionally mounted on a second rotatable shaft 56. The shaft 56 is suitably journalled to the framework 12 so as to extend across the lower end of the hopper 36 and locate the second roller(s) 54 beneath and slightly downstream from the first roller(s) 50 and in feeding engagement with the back panels 46 of the respective envelopes 30 fed thereto by the first roller(s) 50, for feeding the envelopes 30 from the hopper 36 into a path of travel which is inclined at substantially the same angle from the horizontal as that of the tray 36. And the shaft 56 is conventionally connected to, for example, the source of supply of motive power 53, for timely rotating the shaft 56. With the aforesaid envelope stacking and feeding arrangement, the envelopes' lower edges 49 become the leading edges, as they are fed from the hopper 36.

The envelope feeding means additionally includes conventional upper and lower guide plates, respectively designated 58 and 60. The upper guide plate comprises a downwardly curvedly-extending member which is suitably fixedly attached to the framework 12. And the lower guide plate 60 is conventionally fixedly attached to the framework 12 below the level of the hopper 36, for guiding the envelopes 30 downwardly from the hopper 36. For feeding the respective envelopes 30 downwardly from the guide plates 58 and 60 and toward the deck 14, and at the same time opening the envelope flaps 44 and facing each envelope's back panel 46 downwardly, the envelope feeding means includes an upper roller 66, an envelope actuated flap opener 67, a lower roller 68, a drive belt 70 and a pair of guide rollers 72. The roller 66 is conventionally mounted on a shaft 74 which is suitably connected to the framework 12 so as to extend across the path of travel of the envelope 30 and beneath the lower guide plate 60, for locating the outer periphery of the roller 66 for receiving envelopes 30 from the lower end of the plate 60. The flap opener 67 is conventionally pivotably attached to the framework 12 for engagement of the flaps 44 when they are disposed between the guide rollers 72. When the envelope's leading edge 49 strikes the lower edge of the opener 67, the opener's upper edge pivots into engagement with the envelope's back panel 46 so as to raise the flap 44 upwardly as the envelope is downwardly fed by the upper roller 66 between the opener 67 and roller 66. The lower roller 68 is conventionally mounted on a third rotatable shaft 76 which is suitably journalled to the framework 12 so as to extend across the path of travel of the envelopes 30 and beneath the upper roller 66, for locating the outer periphery of the roller 68 upstream from the deck 14 but in close proximity to the level of the deck 14. And the shaft 76 is conventionally connected to, for example, the source of supply of motive power 53 for timely rotating the shaft 76. The drive belt 70 is looped about the upper and lower rollers 66 and 68 and conventionally engaged therewith for movement by the roller 68 when the shaft 76 is rotated. And the rollers 72 are respectively conventionally rotatably mounted on a pair of parallel-spaced shafts 78 which are suitably connected to the framework 12 so as to extend across the path of travel of the envelopes 30 for locating the outer peripheries of the rollers 72 in sufficiently close proximity to the roller 66 to ensure that the rollers 72 urge the envelopes 30 into feeding engagement with the rollers 66 as they are fed from the hopper 38 under the guidance of the guide plates 58 and 60. In addition to the foregoing, the envelope feeding means includes a guide plate 80 which is suitably fixedly attached to the framework 12 beneath the belt 70, so as to extend downwardly in a plane which extends substantially parallel to the portion of the belt run of the belt 70 which extends between the peripheries of the rollers 66 and 68.

For envelope opening purposes the prior art includes an inclined envelope flap plate 82 which has a portion thereof situated upstream of the envelope deck 14 and beneath the guide plate 80, so as to act as an extension of the guide plate 80 and as a ledge for supporting the envelope flap 44 above the level of the deck 14 when the envelope feeding means delivers an envelope 30 to the insertion station 34; it being understood that such delivery contemplates feeding the envelopes 30 downstream on the deck 14 a sufficient distance to dispose the leading edges 49 of the envelopes 30 in engagement with the registration gate 20, as a result of which each envelope's flap 44 is disposed upon the flap plate 82 while the remainder of the envelope 30 overhangs the plate 82 a sufficient distance to ensure that the envelope's front and back panels, 48 and 46, are disposed downstream from the flap plates' lowermost edge 84.

In accordance with the invention the envelope opening means additionally comprises solenoid means including a solenoid 86 (FIG. 1). The solenoid 86 includes a housing 88. The housing 88 is conventionally fixedly attached to the framework 12 and includes an L-shaped depending bracket 90, the lower leg 92 of which has a slot 94 formed therein for forming a pair of spaced apart arms 96. The housing 88 also includes a pair of plunger stops 98, one of which is fixedly attached to each of the arms 96. The solenoid 86 also includes a conventional coil 100, adapted to be connected to a source of supply of D.C. power, and a plunger 102. The plunger 102 is conventionally operationally coupled to the coil 100 and includes a plunger shaft 104, having a slot 106 formed therein from its lower end. The plunger 102 also includes a cross-shaft 108 which extends transversely through the shaft 106, such that it passes through the slot 106, and is of sufficient length to engage the stops 98.

The envelope opening means, according to the invention, also comprises envelope depressor finger means 110 (FIG. 1) including a pair of spaced apart envelope depressor members 112. Each of the depressor members 112 is L-shaped in transverse cross-section and has an upper leg 114 and a lower leg 116. The upper legs 114 are each conventionally pivotably attached to the framework 12, as by means of a pair of spaced-apart pivot pins 118 fixedly attached to the framework 12, so as to dispose the lower legs 116 in overhanging relationship with respect to the flap plate 82 and deck 14, and to enable movement of the lower legs 116 toward and away from the deck 14. And, each of the lower legs 116 includes a pair of spaced-apart, resilient, envelope depressor fingers 120.

According to the invention, the envelope opening means further includes linkage means 130 (FIG. 1). The linkage means 130 interconnects the depressor finger means 110 and solenoid 86 for normally holding the depressor fingers 120 out of the path of travel of delivery of an envelope 30 to the inserting station 34 and for lowering the depressor fingers 120 when the solenoid 86 is operated, whereby the envelope 30 is depressed toward the deck 14 against the resistance of the flap supporting plate 82 after the envelope 30 is delivered.

The linkage means 130 (FIG. 1) includes an elongated arm 132 and a tension spring 134. The upper end of the arm 132 extends through the solenoid bracket slot 94 for coupling to the solenoid plunger shaft 104. To that end, the arm 132 also extends into the plunger shaft slot 106 wherein it is pivotably attached to the plunger shaft 104 by means of the plunger cross-shaft 108. The spring 134 has its lower end conventionally attached to the framework 12, as by means of a pin 136. And the upper end of the spring 134 is conventionally attached to the lower end of the arm 132 for normally urging the arm 132, and thus the plunger shaft 104 downwardly; as a consequence of which the spring 134 normally urges the plunger cross-shaft 108 against the stops 98.

The linkage means 130 also comprises a rocker 138 (FIG. 1) and cam means 140. Rocker 138 is conventionally pivotably attached to the framework 12, as by means of a pivot shaft 142, and has a pair of arms 144 extending in opposite directions as viewed from the pin 142. One of the rocker arms 144 is suitably pivotably attached, as by means of a pivot shaft 146, to the lower end of the arm 132 for movement in step therewith. The cam means 140 includes a cam shaft 148 and a plurality of cams 150A, 150B and 150C. The cam shaft 148 is conventionally journalled to the framework 12 for rotation in place. And the cams 150A, 150B and 150C are mounted at predetermined invervals along the length of the cam shaft 148 and respectively suitably fixedly attached to the cam shaft 148. One of the cams, 150A, extends from the cam shaft 148 toward the rocker 138 and is disposed in camming engagement with the rocker arm 144 opposite to the arm 144 which is pivotably attached to the arm 132. And the other cams, 150B and 150C, respectively extend from the cam shaft 148 toward the depressor finger means 110 for camming engagement, on a one for one basis, with the upper legs 114 of the depressor finger means 110. To hold the legs 114, and thus the finger means 110, in engagement with cams 150B and 150C, and at the same time provide for urging the depressor fingers 116 downwardly toward the deck 14; the linkage means includes a pair of springs 152, each of which is associated with and is looped about one of the pivot pins 118 and has one end conventionally attached to the associated pivot pin 118, and thus to the framework 12, and the other end conventionally attached to the associated upper leg 114 of the depressor finger member 112.

According to the invention, the envelope opening means additionally includes switching means 160 (FIG. 2) for energizing the solenoid 86 when an envelope 30 is delivered to the inserting station 34 and for deenergizing the solenoid 86 when the envelope 30 is removed from the inserting station. The switching means 160 comprises a conventional switch 162, and includes a switch actuator 164 which is pivotably attached to the deck cover 18 so as to normally depend therefrom and extend into the path of travel of the envelope 30 as it is delivered to the inserting station 34. Inasmuch as the actuator 164 depends from the deck cover 18 slightly upstream from the gate 20, the envelope's leading edge 49 engages the actuator 164 just prior to leading edge 49 engaging the gate 20; and, therefore, just prior to completion of delivery of the envelope 30 to the inserting station 34. When the envelope's leading edge 49 engages the switch actuator 164 the switch 162 is actuated; whereas, when the envelope's trailing edge 45 disengages the actuator 164 the switch 162 is deactuated. The switching means 160 additionally comprises conventional means 166, including the aforementioned source of supply of D.C. power, electrically connected by means well-known in the art to the solenoid 86 and switch 162 for energizing the solenoid 86 for operation thereof when the switch 162 is actuated and deenergizing the solenoid 86 when the switch 86 is deactuated.

When the solenoid 86 (FIG. 1) is energized the plunger shaft 104 is retracted from its normally lowered position as shown in FIG. 1; as a result of which the plunger cross-shaft 108 is raised out of engagement with the stops 98 against the tension of the spring 134; whereupon the rocker 138 is rotated clockwise about the pivot shaft 142. Since the springs 152 associated with the depressor finger members 112 are connected to the pivot pins 118 for urging the upper legs 114 of the depressor finger members 112 into engagement with the associated cams 150B and 150C, which the cams 150B and 150C are fixedly attached to the cam shaft 148, the springs 152 tend to rotate the cam shaft 148 counter-clockwise and hold the cam 150A in engagement with the rocker 138. Accordingly, the springs 134 and 152 are constructed and arranged for urging pivotal movement of the rocker 138 in opposite directions. However, clockwise rotation of the rocker 138 results in further counter-clockwise rotation of the cam 150A and thus the cam shaft 148. And, when the cam shaft 148 is so rotated, the depressor members 112 are rotated clockwise for lowering the depressor fingers 120 toward the deck 14 and into engagement with the address panel 48 of an envelope 30 which has been delivered to the inserting station 34. Accordingly, the springs 134 and 152 cooperate with the rocker 138 for rotating the cam shaft 148 in the appropriate direction for lowering the depressor fingers 120 toward the deck 14 when the solenoid 86 is operated. In this connection it is noted that although the switch actuator 164 (FIG. 2) is located upstream from the gate 20, the electro-mechanical time delay between the envelope's engagement of the actuator 164 and the depressor fingers 120 being lowered into engagement with the envelope 30, is greater than the elapsed time interval between the envelope's engagement of the actuator 164 and the envelope's engagement of the gate 20; as a result of which the depressor fingers 116 are lowered into engagement with the envelope 30 after the envelope 30 has been delivered to the inserting station 34.

When the depressor fingers 116 (FIG. 2) are lowered into engagement with the envelope 30, they sufficiently depress the envelope 30 toward the deck 14, against the resistance of the flap supporting plate 84, to open the envelope 30 enough to permit insertion of a plurality of conventional stripper fingers 170 into the envelope 30. And, in this connection the envelope opening means, in accordance with the prior art, additionally includes conventional means 172, including the stripper fingers 170, for stripping apart from each other the front and back panels, 48 and 46, of the envelopes 30 to permit insertion of enclosure 178 into the envelopes 30. The stripping means 172 is conventionally connected to, for example, the source of supply of motive power 53 for timely operation thereof, and generally comprises a plurality of finger extension tie bars 174, short levers 176 and long levers 178. The lower ends of the respective levers, 176 and 178, are spaced apart from each other and conventionally pivotably attached to the framework 12 as by means of a pair of pivot pins 180. The respective upper ends of the levers, 176 and 178, are conventionally spaced apart from each other and pivotably attached to a tie bar 174, as by means of a pair of a pivot pin 182. As shown by the dot-dash lines in FIG. 2, the fingers 170 are normally located beneath the envelope flap plate 82. After each envelope 30 is delivered to the inserting station 34 and the depressor fingers 120 are lowered into depressing engagement with the envelope 30, the stripping means 172 is timely operated for moving the stripper fingers 170 out from beneath the flap plate 82 and downstream for insertion into the envelope 30 so as to strip apart from each other the envelope's front and back panels, 48 and 46, for subsequent insertion of an enclosure 178 into the envelope 30.

For inserting enclosures 178 (FIG. 2) into the envelopes 30 and removing the envelopes 30 from the inserting station 34, in accordance with the prior art; the machine 10 includes conventional enclosure ram means 190 and a pair of conventional outfeed pinch rollers 192. The ram means 190 generally comprises a reciprocable ram plate 194 having a depending portion 196 which conventionally engages the enclosures 178. Assuming the stripper fingers 170 have opened the envelope 30; on the forward stroke of the ram plate 194, the plate 194 moves to the right, as portrayed in FIG. 2, and carries therewith the enclosures 178 into the throat of the opened envelope 30. As is well known in the art, the ram plate 194 also moves the stuffed envelope 30 downstream and into feeding engagement with the outfeed rollers 192. Accordingly, the ram means 190 and outfeed rollers 192 cooperate with each other for removing stuffed envelopes 30 from the inserting station 34.

As the stuffed envelope 30 (FIG. 3) is removed from the inserting station 34, the envelope's trailing edge 45 is disengaged from the switch actuator 164. Whereupon the switch 162 is deactuated for deenergizing the solenoid 86 (FIG. 1). When the solenoid 86 is deenergized, the plunger shaft 104 is urged downwardly by the spring 134 until the plunger cross-shaft 108 is lowered into engagement with the stops 108; causing and the arm 132 to rotate the rocker 138 counter-clockwise about the pivot pin 142. When so rotated, the rocker 138 rotates the cam 150A and thus the attached cam shaft 148 clockwise, for raising the depressor fingers 120 out of the path of travel of the next envelope 30 to be delivered to the inserting station 34. When so raised, the depressor fingers 120 are located in a predetermined position above the level of the deck 14, where the depressor fingers 120 are normally disposed. In this connection it is noted that the plunger cross-shaft 108 and stops 98 cooperatively define the aforesaid predetermined position of the depressor finger members 120 with respect to the deck 14.

In accordance with the objects of the invention there has been described an improvement in envelope stuffing apparatus, including improved means for opening the envelope. More particularly, there has been described improved means, operable in response to delivery of an envelope to the inserting station of the apparatus, for depressing the envelope after delivery to the inserting station.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In envelope stuffing apparatus which has an enclosure inserting station and includes a deck at the inserting station, and includes means for delivering the envelope in a path of travel to the inserting station, and includes means for opening the envelope, and includes means for inserting an enclosure into the envelope and for removing the envelope from the inserting station, and wherein said opening means includes means for supporting the flap of the envelope above the deck, and said opening means includes first finger means insertable into the envelope for stripping apart from each other the front and back panels of the envelope, an improvement in the envelope opening means, said improvement comprising:

(a) solenoid means operable in response to delivery of the envelope to the inserting station;

(b) second finger means for depressing the envelope toward the deck against the resistance of the flap supporting means; and (c) linkage means interconnecting the second finger means and solenoid means for normally holding the second finger means out of the path of travel of delivery of said envelope and for lowering the second finger means into engagement with the envelope when the solenoid means is operated, whereby the envelope is depressed toward the deck after the envelope is delivered, and said lowered second finger means depressing said envelope sufficiently to open said envelope enough to permit insertion of said first finger means into said envelope.

2. The improvement according to claim 1, wherein said second finger means is disposed in overhanging relationship with respect to said deck, and said linkage means including a spring for urging said second finger means toward said deck.

3. The improvement according to claim 1, wherein said solenoid means includes plunger means and a stop, said linkage means including a spring for normally urging said plunger means against said stop, and said spring cooperative with said stop for locating said second finger means in a predetermined position with respect to said deck.

4. The improvement according to claim 1, wherein said linkage means includes a rotatable cam shaft, and said linkage means including a cam fixedly attached to said shaft for rotation therewith and disposed in engagement with said second finger means, whereby rotation of said shaft results in movement of said second finger means relative to said deck.

5. The improvement according to claim 1, wherein said delivery means includes switching means actuated by said envelope, and said switching electrically connected for operating said solenoid means when said switching means is actuated.

6. The improvement according to claim 3, wherein said linkage means includes a rocker and an arm, said arm pivotably attached to one end of said plunger means, said rocker pivotably attached to the other end of said arm, said spring attached to said arm for normally urging said arm and thereby said plunger means against said stop, whereby said spring cooperates with said stop for positioning said linkage means such that said second finger means is normally located in said predetermined position with respect to said deck.

7. The improvement according to claim 5, wherein said second finger means is disposed in overhanging relationship with respect to said deck, said linkage means including a rotatable cam shaft, said linkage means including a cam disposed in engagement with said second finger means and fixedly attached to said cam shaft for rotation therewith, said linkage means including a second spring for urging said second finger means into engagement with said cam, said linkage means including a second cam fixedly attached to said shaft for rotation therewith, said second cam disposed in engagement with said rocker, said second spring urging said second cam into engagement with said rocker, said springs urging pivotal movement of said rocker in opposite directions, and said springs cooperating with said rocker for rotating said cam shaft in a direction which lowers said second finger means toward said deck when said solenoid means is operated.

8. The improvement according to claim 7, wherein said envelope opening means includes switching means actuated by the leading edge of said envelope when said envelope is delivered to said inserting station, said switching means electrically connected to said solenoid means for energizing said solenoid means for operation thereof when said switching means is actuated, said switching means deactuated by the trailing edge of said envelope when said envelope is removed from said inserting station, and said switching means electrically connected to said solenoid means for deenergizing said solenoid means when said switching means is deactuated, whereby said second finger means are lowered for a predetermined time interval after delivery of the envelope to the inserting station.

* * * * *